US010309147B1

(12) United States Patent
Valdes et al.

(10) Patent No.: US 10,309,147 B1
(45) Date of Patent: Jun. 4, 2019

(54) FRAMELESS IMPACT DOOR SYSTEM

(71) Applicants: Rene Valdes, Tampa, FL (US); Angelo Rivera, Oldsmar, FL (US); John Faour, Tampa, FL (US)

(72) Inventors: Rene Valdes, Tampa, FL (US); Angelo Rivera, Oldsmar, FL (US); John Faour, Tampa, FL (US)

(73) Assignee: Faour's Mirror Corp., Tampa, FL (US)

( * ) Notice: Subject to any disclaimer, the term of this patent is extended or adjusted under 35 U.S.C. 154(b) by 83 days.

(21) Appl. No.: 15/490,973

(22) Filed: Apr. 19, 2017

Related U.S. Application Data

(60) Provisional application No. 62/479,935, filed on Mar. 31, 2017.

(51) Int. Cl.

| | |
|---|---|
| ***E06B 3/02*** | (2006.01) |
| ***E06B 1/52*** | (2006.01) |
| ***E06B 7/16*** | (2006.01) |
| ***E05B 65/10*** | (2006.01) |
| ***E06B 3/36*** | (2006.01) |

(52) U.S. Cl.
CPC ..... *E06B 3/025* (2013.01); *E05B 65/1006* (2013.01); *E06B 1/52* (2013.01); *E06B 3/362* (2013.01); *E06B 7/16* (2013.01)

(58) Field of Classification Search
CPC ..... E06B 3/02; E06B 3/362; E06B 3/025
See application file for complete search history.

(56) References Cited

U.S. PATENT DOCUMENTS 2,936,050 A * 5/1960 McLaughlin ..... B32B 17/10045 351/146
3,864,204 A * 2/1975 Shorr ..... B32B 17/10045 428/213
3,930,452 A * 1/1976 Van Laethem ... B32B 17/10045 109/80
4,366,974 A * 1/1983 Horgan, Jr. ..... E05B 65/106 292/336.3
4,688,406 A * 8/1987 Horgan, Jr. ..... E05B 63/0021 292/1.5
5,244,709 A * 9/1993 Vanderstukken ..... A62C 2/06 428/99
5,615,918 A * 4/1997 Ferrell ..... E05B 1/0015 292/336.3
5,747,170 A * 5/1998 Von Alpen ..... B32B 17/10045 296/97.2

(Continued)

*Primary Examiner* — Catherine A Kelly
(74) *Attorney, Agent, or Firm* — Nicholas Pfeifer; Smith & Hopen, P.A.

(57) ABSTRACT

A glass door construction set in a pre-existing frame includes glass door leaves made of two or more panes of glass, which define a top edge, a bottom edge, and two lateral edges. The top and bottom edges include a top and bottom rail, respectively, to enhance the structural integrity of the glass door leaves. The lateral edges, however, remain free of the typical perimeter framing required on current glass doors to meet the stringent impact standards. The glass door leaves each include handles on either side of the glass leaves that are interconnected to effectively create a structural equivalent of an I-beam. The handles provide the necessary structural rigidity along a vertical extent to meet impact standards.

15 Claims, 7 Drawing Sheets

(56) References Cited

U.S. PATENT DOCUMENTS

| | | | | |
|---|---|---|---|---|
| 6,401,428 | B1 * | 6/2002 | Glover | E06B 3/24 52/786.1 |
| 6,609,350 | B1 * | 8/2003 | Weber | B32B 17/10036 52/784.1 |
| 6,726,257 | B2 * | 4/2004 | Horgan, Jr. | E05B 3/00 292/336.3 |
| 7,347,461 | B2 * | 3/2008 | Sprague | E05B 1/00 200/61.62 |
| 7,849,718 | B2 * | 12/2010 | Ambrass | E05B 1/0015 292/167 |
| 9,273,934 | B2 * | 3/2016 | Engl | B32B 17/10045 |
| 2004/0094972 | A1 * | 5/2004 | Sprague | E05B 1/00 292/336.3 |
| 2010/0227135 | A1 * | 9/2010 | Takagi | B32B 17/10018 428/215 |
| 2014/0162039 | A1 * | 6/2014 | Zachau | F41H 5/0407 428/219 |
| 2015/0128503 | A1 * | 5/2015 | Roh | E06B 3/02 49/462 |
| 2016/0290031 | A1 * | 10/2016 | Stazi | E06B 3/02 |
| 2017/0348945 | A1 * | 12/2017 | Chaussade | B32B 17/10036 |
| 2017/0365114 | A1 * | 12/2017 | Bettencourt | E05B 47/0043 |

* cited by examiner

FRAMELESS IMPACT DOOR SYSTEM

BACKGROUND OF THE INVENTION

1. Field of the Invention

This invention relates, generally, to door construction. More particularly, it relates to an all glass frameless door that meets hurricane and other impact standards.

2. Description of the Prior Art

Conventional glass door systems that meet impact standards may include a transparent impact-resistant pane that is mounted in a pre-existing frame that engages the peripheral edges of the pane. These frames are often formed of steel or other suitable materials. The use of vertical frames engaging the peripheral edges of each pane, thereby creates an unsightly metallic perimeter that detracts from the aesthetic appeal of the glass doors. Such prior art frames call attention to themselves instead of the view outside the doors.

Accordingly, there is a need for door systems that meet impact standards and also provide aesthetically pleasing frameless glass door leafs. Such a door would allow the view beyond the door to be fully appreciated without sacrificing the structural integrity of the door.

However, in view of the art considered as a whole at the time the present invention was made, it was not obvious to those of ordinary skill in the art how the needed frameless window system could be provided.

SUMMARY OF THE INVENTION

The long-standing but heretofore unfulfilled need for a door system that meets impact standards while obviating the need for prior art framing of each individual door leaf on all four edges of the leaf is now met by a new, useful, and non-obvious invention.

An embodiment of the novel door system includes a door frame configured to be secured within a door opening. The door frame includes a header, a sill, and two vertical door jambs, collectively forming a rectangular shaped frame. A first glass door leaf and a second glass door leaf are pivotally secured within the door frame.

Each glass door leaf preferably includes two or more panes of glass in overlying relation. The two or more panes of glass collectively define a top edge, bottom edge, a first lateral edge, and a second lateral edge. The first lateral edge is proximate to one of the vertical door jambs, and there are no visible framing supports secured along the first and second lateral edges.

A first top rail engages the top edge of the first glass door leaf and is adapted to enhance the structural integrity along a lateral extent of the first glass door leaf. Moreover, the top rail is adapted to pivotally mount to the horizontally disposed header frame. A second similar top rail engages the second glass door leaf and performs the same functions.

Each glass door leaf also includes a bottom rail that engages the bottom edge of the glass door leaf. The bottom rail similarly is adapted to enhance the structural integrity along the lateral extent of its respective glass door leaf, and is adapted for pivotally mounting to the horizontally disposed sill frame.

The novel door system further includes a first handle on an interior surface of each door leaf extending in a vertical direction and secured to the top and bottom rails proximate to the second lateral edge. A second handle is located on an exterior side of each door leaf extending in a vertical direction and secured to the top and bottom rails proximate to the second lateral edge. In an embodiment, the two handles are secured to each other along the length of the handles at predetermined intervals. The two handles are secured to each other within a plane perpendicular to the plane of the respective door leaf.

The second lateral edges of both the first glass door leaf and the second glass door leaf are proximate each other when the first and second glass door leaves are secured within the door frame and in a closed position and a seal resides between the second lateral edges of both the first glass door leaf and the second glass door leaf.

An embodiment further includes a jamb receipt/pocket disposed on the inwardly facing surfaces of each of the two vertical door jambs. Each jamb receipts comprises of a first vertical support having a width extending from the door jamb towards the middle of the door frame and a length extending vertically with the door jamb; and a second vertical support having a width extending from the door jamb towards the middle of the door frame and a length extending vertically with the door jamb. The first vertical support is separated from the second vertical support in a direction perpendicular to the plane of each door leaf creating a receiving space for the first lateral edge of one of the glass door leaves. An embodiment includes a seal between the first lateral edge of each door leaf and the respective door jambs. Moreover, an embodiment may include a seal between the first vertical support in each jamb receipt and the respective glass door leaf, and a seal between the second vertical support in each jamb receipt and the respective glass door leaf.

An embodiment also includes a locking mechanism disposed in one of the handles. The locking mechanism has a locking pin adapted to axially protrude from the handle and contact the header and/or sill in the door frame when the locking mechanism is in a locked position. In the unlocked position, the locking pin in out of contact with the header and sill in the door frame allowing the door leaf to move to an open position.

An important object of this invention is to provide a door system that meets impact standards, but which does not require vertical frames that are mounted around the lateral/peripheral vertical edges of the door leaves.

A more specific object is to provide such a system where one or more glass panes may be engaged by a frame structure at their upper and lower edges only.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention includes one or more glass doors having a frameless design to improve the aesthetics of glass door systems. The term "frameless" is intended to describe the lack of vertical framing along the perimeter, or "peripheral edge," of each glass leaf in the door system. All current impact glass doors require framing, typically U-shaped, encasing the entire perimeter of each glass door leaf in order to meet the stringent impact resistant standards. In contrast, the present invention includes a novel and nonobvious design for a glass door system that can achieve impact standards without the requirement of perimeter framing around each glass door leaf. In addition, the door system of the present invention is designed to be easily assembled as a kit in an existing door opening.

Figure 1:
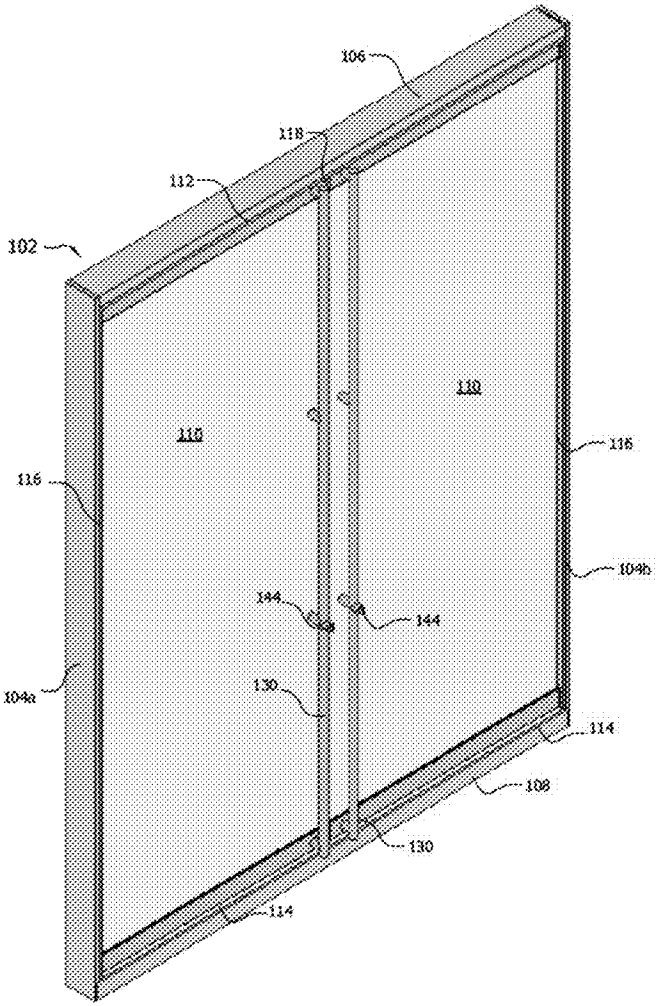
FIG. 1 is a perspective of an embodiment of the present invention.
Figure 2:
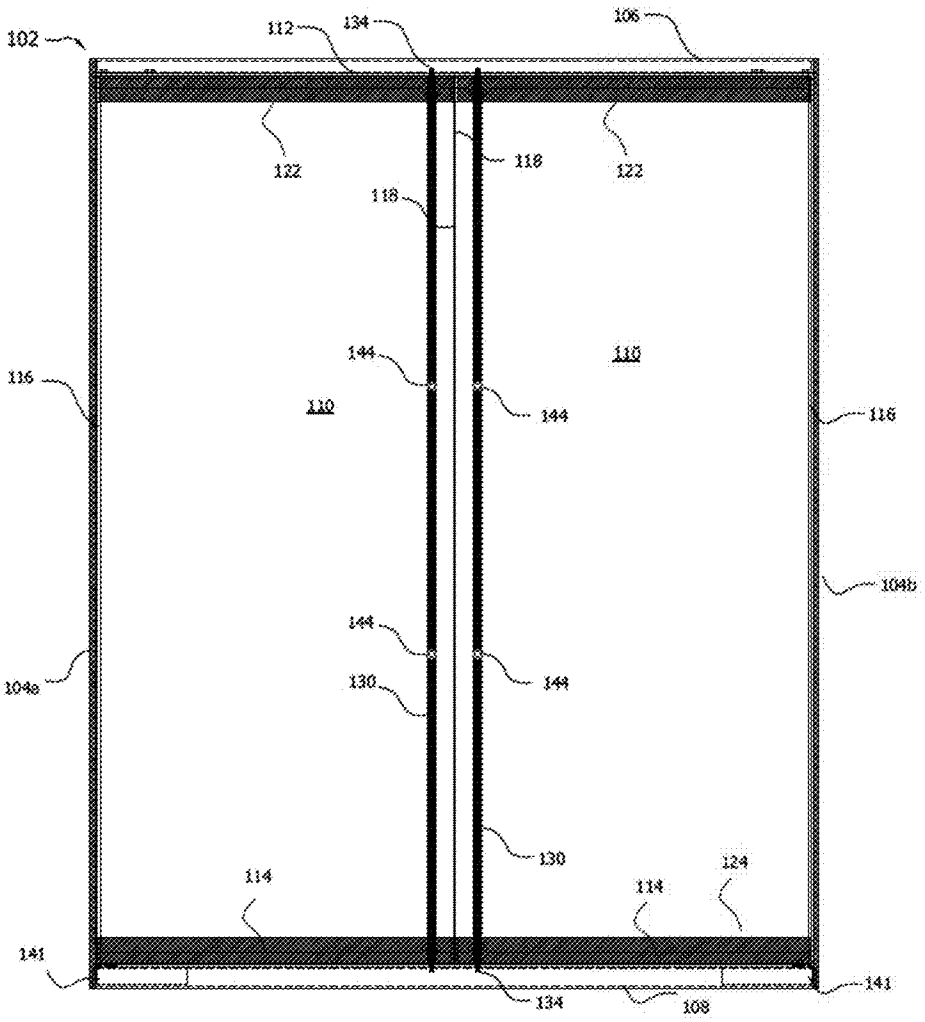
FIG. 2 is an elevation view of an embodiment of the present invention.

Referring now to FIGS. 1-2, an embodiment of the present invention includes a structural frame 102 defined by vertical door jambs 104*a*, 104*b*, header 106 and sill 108. Frame 102 may be premanufactured as a single unit to allow for easy installation and/or may be custom built and installed on site. Frame 102 is intended to be secured into a door opening by any fastening means, including adhesion, commonly used to secure a door jamb or frame to a door opening.

The embodiment in FIG. 1 is a two-door system in which door leaves 110 are hung within frame 102. Each door leaf 110 is defined by a perimeter made up of top edge 112, bottom edge 114, first lateral edge 116 and second lateral edge 118. As shown, door leaves 110 lack the typical vertical perimeter framing required in current glass doors to meet the impact standards.

Figure 3:
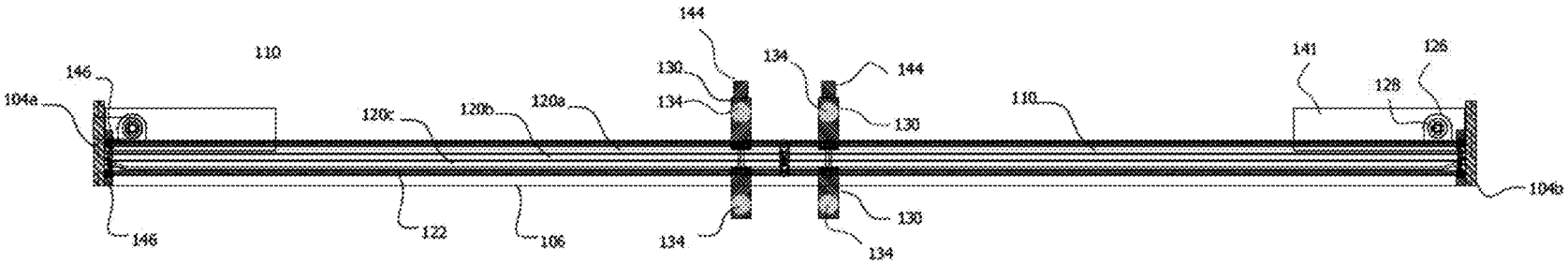
FIG. 3 is a top view of an embodiment of the novel structure.

As depicted in FIG. 3, each leaf 110 is comprised of multiple panes of glass. The leaves preferably include three laminations: exterior pane 120*a* has a minimum thickness of a quarter inch (¼"), and middle pane 120*b* and interior pane 120*c* have preferable thicknesses of three-eighths of an inch (⅜") with a minimum thickness of a quarter inch (¼"). All three panes are preferably clear heat strengthened. DUPONT® 0.090 S.G. glass performs well. However, this invention is not limited to any particular number of laminations of glass panes, or to any particular thickness of each lamination, or to any particular treatment of glass panes because it works with any suitable impact-resistant glass, not just the preferred glass.

Figure 4:
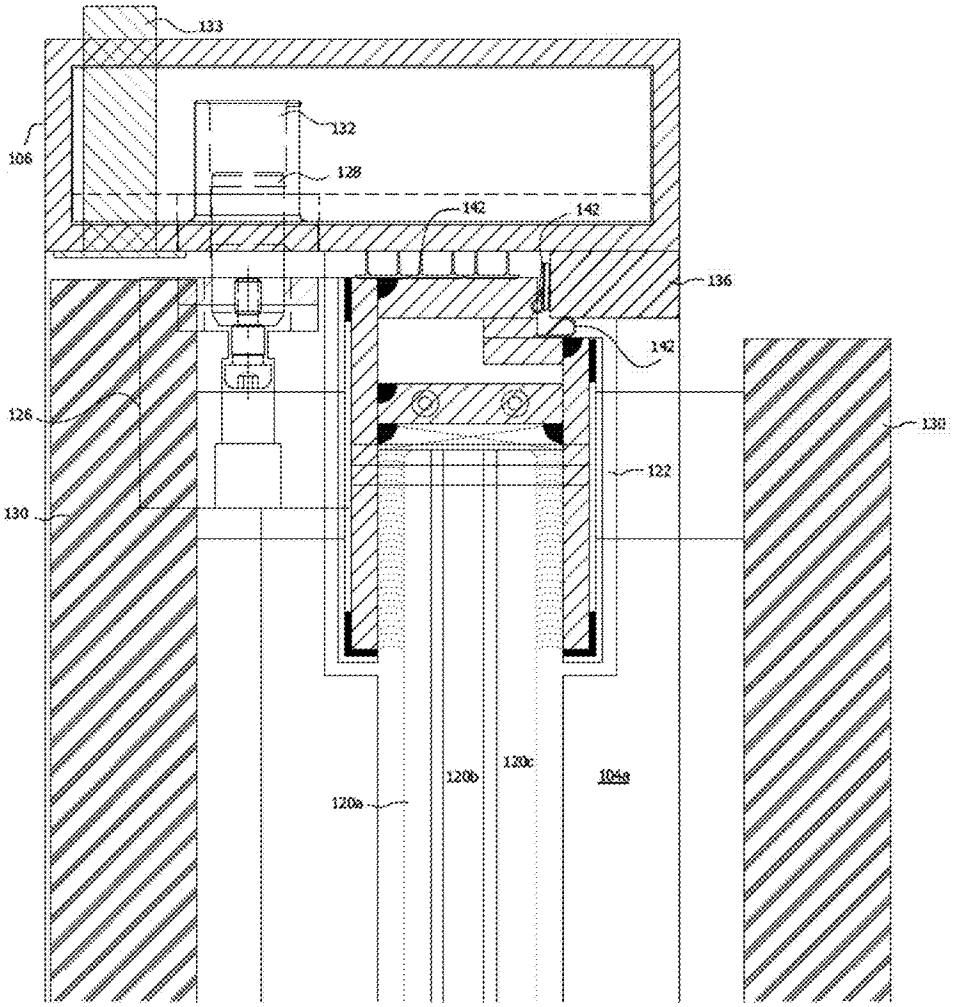
FIG. 4 is a side sectional view of an embodiment of the present invention highlighting the header and upper portion of the door.

Top edge 112 includes top rail 122, in which the glass panes 120 are preferably sandwiched. In an embodiment, top rail 122 is a generally U-shaped aluminum channel having a lateral extent generally equal to the lateral extent of door leaf 110. The channel opens downwardly as depicted in FIG. 4.

Figure 5:
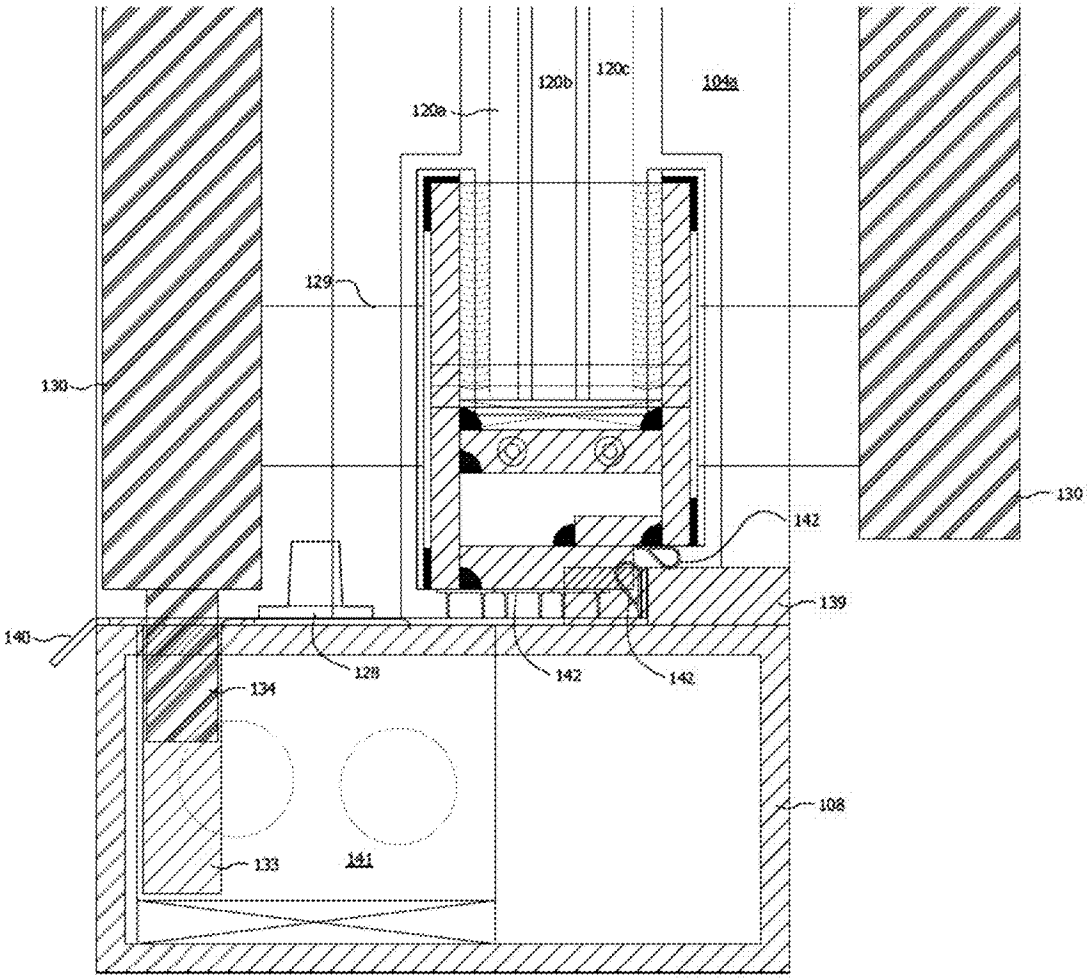
FIG. 5 is a side sectional view of an embodiment of the present invention highlighting the sill and lower portion of the door.

Likewise, bottom edge 114 includes bottom rail 124, in which glass panes 120 are preferably sandwiched. In an embodiment, bottom rail 124 is a generally U-shaped aluminum channel having a lateral extent generally equal to the lateral extent of door leaf 110. The channel opens upwardly as depicted in FIG. 5.

Top and bottom rails 122, 124 provide enhanced lateral/horizontal structural integrity of glass door leaves 110. In addition, top and bottom rails 122, 124 provide the structural hard points on which pivot structures 126, and in turn pivot pins 128, and handles 130 attach to door leaves 110.

Handles 130 provide the necessary vertical support allowing the glass doors, lacking unsightly perimeter framing, to meet the impact standards. As depicted in FIG. 3, an embodiment includes handles 130 located on both the interior and exterior surfaces of door leaves 110. As a result, handles 130 operate as an I-beam to provide the necessary vertical support required to meet the impact standards. In an embodiment, through bolts 129 extend between the interior and exterior handles 130 and pass through glass panes 120 at predetermined spacing along the length of the handles. In addition, handles 130 are preferably secured at upper rail 122 and bottom rail 124.

As depicted in FIG. 4, header portion 106 of frame 102 is preferably a hollow rectangular structure to reduce material costs. In addition, header 106 includes a pivot pin receipt/aperture 132 axially aligned with pivot pin 128 when door leaf 110 is secured within frame 102. Header 106 also includes one or more locking pin receipts/apertures 133 axially aligned with at least one of handles 130 to receive locking pins 134, which axially translate into and out of handles 130.

In an embodiment, header 106 further includes door stop 136 secured thereto and extending downwardly towards sill 108. When viewed from a profile perspective, door stop 136 is located on the opposite side of door leaf 110 with respect to pivot structure 126. Door stop 136 is intended to reside on the side of door leaf 110 that is opposite to the side on which the door swings open. An embodiment further includes a seal disposed between door stop 136 and door leaf 110 with the door stop 136 located a predetermined distance from door leaf 110 to ensure that door leaf 110 comes to rest in a closed position parallel to header 106 and sill 108.

As shown in FIG. 5, sill 108 of frame 102 likewise includes locking pin receipt 133 to receive locking pin 134. Rather than having a pivot pin receipt, however, sill 108 includes pivot pin 128. Pivot pin 128 is axially aligned with pivot pin receipt 132, which is attached to bottom rail 124, when door leaf 110 is secured within frame 102. Furthermore, pivot pin 128 is preferably in mechanical communication with door closure 141. Door closure 141 may be any mechanism used to apply a biasing force urging the door leaf to move into the closed position. Door closure 141 preferably resides within sill 108 to keep the door leaves free of unappealing mechanical components.

It should be noted that while FIG. 4 depicts pivot pin secured to top rail 122 and pivot pin receipt 132 residing in header 106, it is considered that the pivot pin 128 may be secured to header 106 and pivot pin receipt 132 may be secured to top rail 122. In similar fashion it is considered that an embodiment may include pivot pin 128 secured to bottom rail 124 and pivot pin receipt 132 disposed in sill 108.

Referring back to FIG. 5, sill 108 preferably also includes a door stop 139 secured on the same side of door leaf 110 as upper door stop 136. Door stop 139 may be integrated into threshold 140 to create a seamless bottom sill as depicted in the reference figure.

An embodiment includes seals 142 located between header 106 and top rail 122, between sill 108 and bottom rail 124, and also between door stops 136, 139 and header 106 and sill 108, respectively. The seals may be any seals commonly used or capable of being used to seal doorways.

Referring back to FIGS. 1-2, an embodiment includes a locking mechanism disposed within at least one of the handles 130 on each door leaf 110. The locking mechanism includes actuator 144 in mechanical communication with locking pin 134. When in the unlocked position, locking pin 134 is disengaged with locking pin receipt 133. When actuator 144 in switched to a locked position, locking pin 134 travels in an axial direction to at least partially extend out of handle 130 and enter locking pin receipt 133. When in the locked position, door leaf 110 is unable to pivot open. An embodiment may include a locking pin at both the top end and the bottom end of the same handle 130. Both locking pins may be translated through a single actuator or through individual top and bottom actuators.

Figure 6:
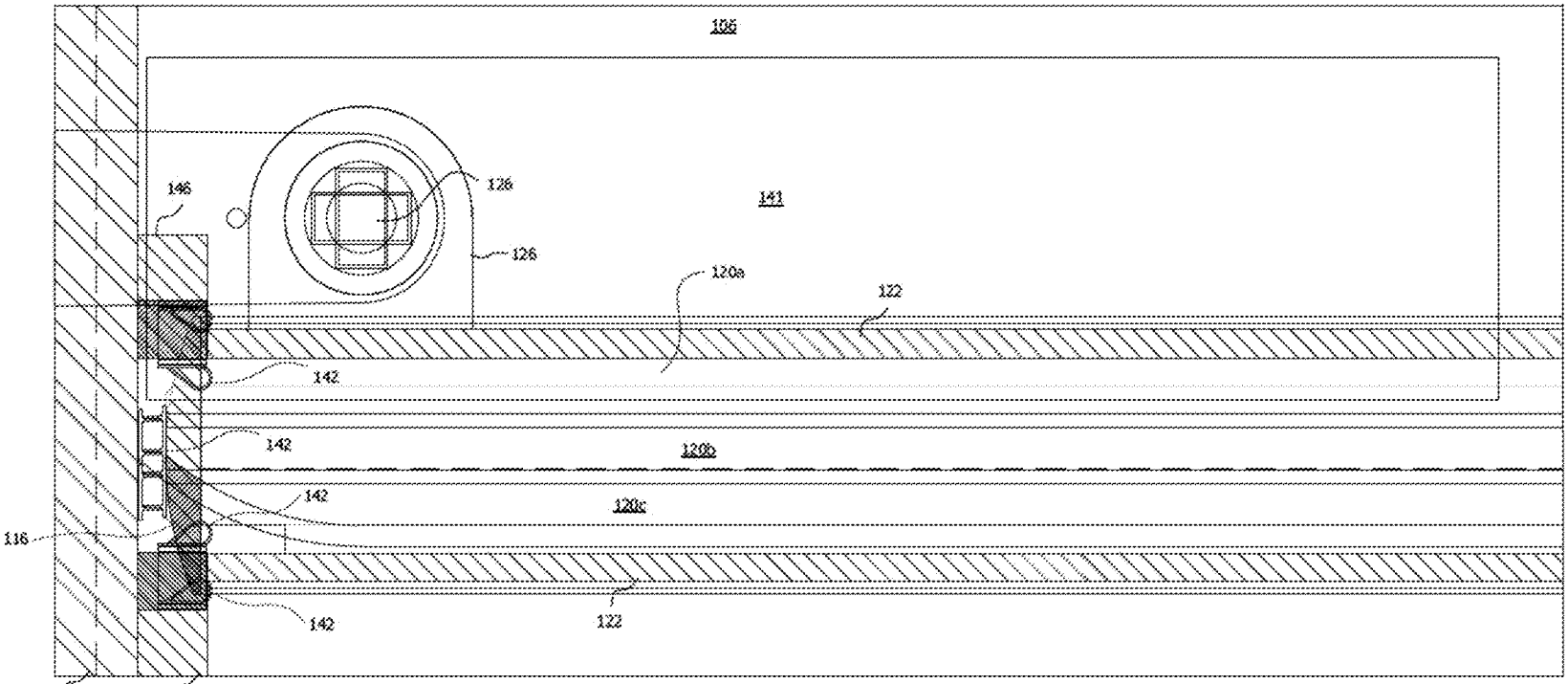
FIG. 6 is a top sectional view of a lateral edge of the door leaf and vertical door jamb when the lateral edge of the door leaf is secured within the jamb receipt.

Referring now to FIG. 6, vertical door jambs 104*a*, 104*b* each include a jamb pocket defined by vertical members 146. First lateral edge 116 of door leaf 110 is intended to reside within the jamb pocket which is equipped with several seals 142 to create a sealed doorway as shown in FIG. 6. Additionally, first lateral edge 116 is preferably rounded to allow the door leaf to pivot without contacting the vertical members 146. An additional seal 142 is preferably attached to the first lateral edge to help ensure that the jamb pocket remains sealed even as the door leaf pivots.

Vertical member 146 also provide an unseen vertical support when door leaf 110 is subjected to impact or pressure forces. When subject to enough force, first lateral edge 116 will contact one of the vertical member 146, which will effectively act as a perimeter frame to support the glass leaf 110.

Figure 7:
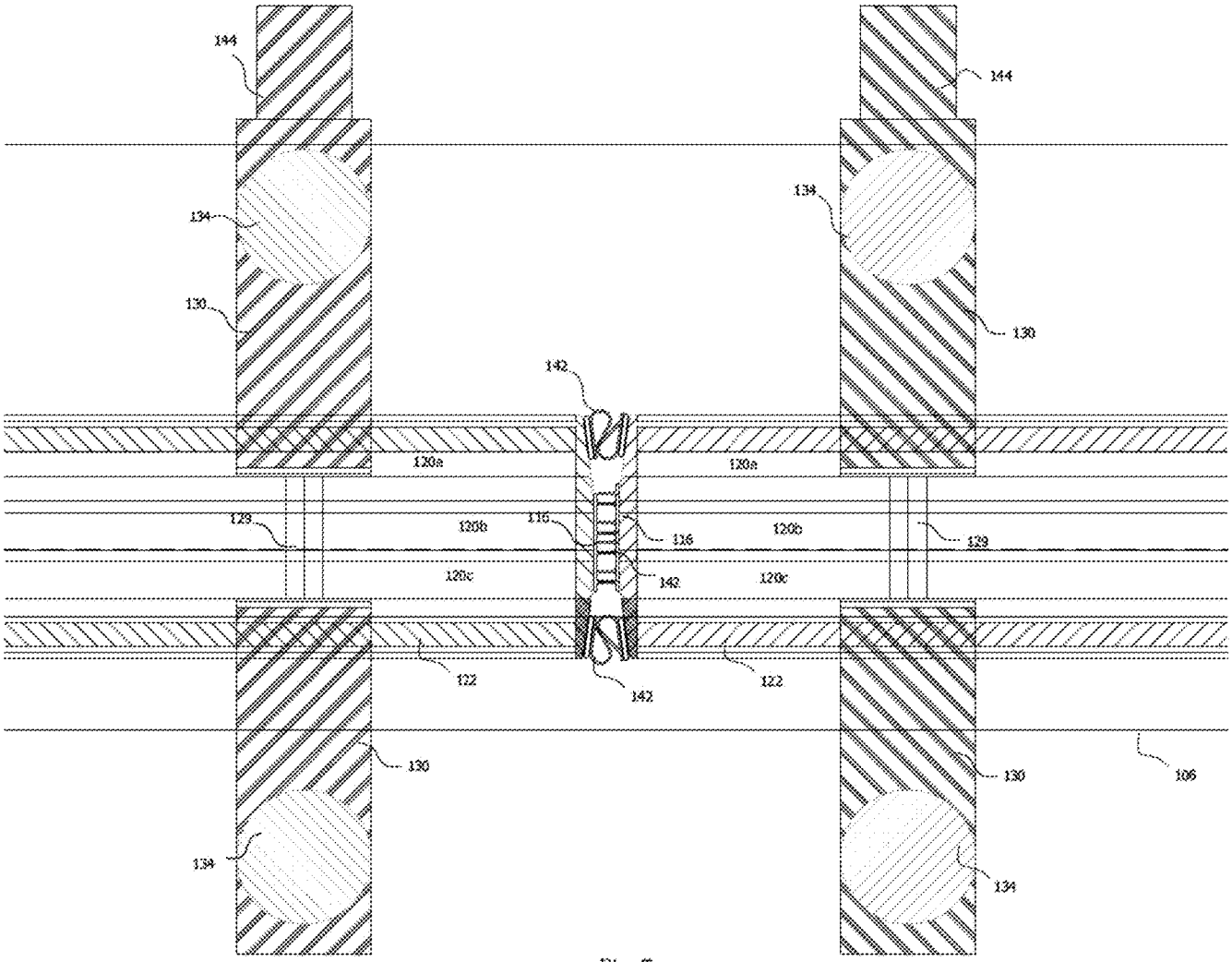
FIG. 7 is a top sectional view of a lateral edge of the door leaf where two door leaves meet in the center of the door frame.

As depicted in FIG. 7, an embodiment of the present invention includes seal 142 secured to one or both of the second lateral edges 118. As previously explained seal 142 may be any seal known to a person of ordinary skill in the art for sealing a doorway.

In an embodiment, door leaves 110 may be sliding doors or rotating doors rather than the traditional pivoting door shown in the exemplary figures. Regardless of how the door open or close, each door leaf includes at least one vertical handle extending between the top and bottom rails, and is able to meet the impact standards without perimeter framing.

GLOSSARY OF CLAIM TERMS

Bottom Rail: is a structural member of any shape secured to or proximate to the bottom edge of the glass door leaf.

Door Leaf: is a single panel of a door.

Glass Door Leaf: is a door leaf comprising of glass.

Internal Pane: is a pane of glass residing between the interior and exterior panes of glass.

Seal: is an object or substance used to bring together two other objects to help prevent the passage of material or fluids between the two objects.

Structural Integrity: is the ability of an object to resist breaking or deforming under loads.

Top Rail: is a structural member of any shape secured to or proximate to the top edge of the glass door leaf.

Visible Framing: means structural members other than glass which are visible on either the interior or exterior surfaces of the glass door leaves.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A glass door system, comprising:

a first glass door leaf defined by a top edge, bottom edge, a first lateral edge, and a second lateral edge, the first glass door leaf comprising an interior pane having a minimum thickness of 0.25 inches, an exterior pane having a minimum thickness of 0.25 inches, and an internal pane having a minimum thickness of 0.25 inches;

there being no visible framing along the first and second lateral edges;

a top rail that engages the top edge and is adapted to enhance the structural integrity along a lateral extent of the glass door leaf;

a bottom rail that engages the bottom edge and is adapted to enhance the structural integrity along the lateral extent of the first glass door leaf;

a first handle extending generally from the top rail to the bottom rail in a vertical direction proximate to the second lateral edge, wherein in the first handle further includes a locking mechanism disposed within the first handle, the locking mechanism including an actuator having a locked and an unlocked position, the locked position including an upper locking pin axially extended from the first handle to be received by a header locking pin aperture disposed within a header frame and a lower locking pin axially extended from the first handle to be received by a sill locking pin aperture disposed within a sill frame; and whereby the minimum thicknesses of the interior, exterior, and internal panes in combination with placing the locking mechanism in the locked position establishes an impact resistant door leaf.

2. The glass door system of claim 1, further comprising a second handle secured to the first handle on an opposite the side of the first glass door leaf, such that the first handle and second handle are aligned with a plane that is perpendicular to a plane in which the glass door leaf resides.

3. The glass door system of claim 1, further comprising a door frame configured to be secured within a door opening, the door frame including a header, a sill, and two vertical door jambs, collectively forming a rectangular shape.

4. The glass door system of claim 3, further comprising the top rail adapted for pivotally mounting to the header and the bottom rail adapted for pivotally mounting to the sill.

5. The glass door system of claim 3, further comprising a jamb pocket disposed on the inwardly facing surfaces of one of the two vertical door jambs, the jamb pocket including:

a first vertical support having a width extending from the door jamb towards the middle of the door frame and having a length extending vertically with the door jamb, the width establishing a planar contacting surface that is generally parallel to a plane in which the glass door leaf resides when in a closed orientation;

a second vertical support having a width extending from the door jamb towards the middle of the door frame and having a length extending vertically with the door jamb, the width establishing a planar contacting surface that is generally parallel to a plane in which the glass door leaf resides when in the closed orientation;

the first vertical support separated from the second vertical support in a direction perpendicular to the plane of the door leaf creating a receiving space for the first lateral edge of the glass door leaves;

whereby the planar contacting surfaces of the first and second vertical supports provide structural reinforcement when the door leaf is subject to impact forces.

6. A glass door system, comprising:

a first glass door leaf and a second glass door leaf, each glass door leaf including:

two or more panes of glass in overlying relation, the two or more panes of glass collectively defining a top edge, bottom edge, a first lateral edge, and a second lateral edge;

the first lateral edge being proximate to a first vertical section of door jamb, and there being no visible framing supports extending along the first and second lateral edges;

a top rail that engages the top edge and is adapted to enhance the structural integrity along a lateral extent of each glass door leaf, and the top rail adapted for pivotally mounting to a horizontally disposed header frame;

a bottom rail that engages the bottom edge and is adapted to enhance the structural integrity along the lateral extent of each glass door leaf, and the bottom rail adapted for pivotally mounting to a horizontally disposed sill frame;

a first handle on an interior surface of each door leaf extending in a vertical direction and secured to the top and bottom rails proximate to the second lateral edge;

a second handle on an exterior surface of each door leaf extending in a vertical direction and secured to the top and bottom rails proximate to the second lateral edge;

the first handle aligned and secured to the second handle along a plane perpendicular to a plane of each door leaf;

the second lateral edges of both the first glass door leaf and the second glass door leaf being proximate each other when the first and second glass door leaves are secured within a door opening and in a closed position;

a left jamb pocket and a right jamb pocket, wherein each jamb pocket is disposed on the inwardly facing surface of a respective vertical doorjamb, each jamb pocket further including:

a first vertical support having a width extending from the respective vertical door jamb towards the middle of the door frame and having a length extending vertically with the respective vertical door jamb, the width establishing a planar contacting surface that is generally parallel to a plane in which the glass door leaf resides when in the closed position;

a second vertical support having a width extending from the respective vertical door jamb towards the middle of the door frame and having a length extending vertically with the respective vertical door jamb, the width establishing a planar contacting surface that is generally parallel to a plane in which the glass door leaf resides when in the closed position; and the first vertical support separated from the second vertical support in a direction perpendicular to the plane of the door leaf when the door leaf is in the closed position, the separation of the first and second vertical supports creating a receiving space for the first lateral edge of one of the glass door leaves; and whereby the planar contacting surfaces of the first and second vertical supports provide structural reinforcement when the glass door leaves are subject to impact forces.

7. The glass door system of claim 6, wherein the two or more panes further includes an interior pane having a minimum thickness of 0.25 inches, an exterior pane having a minimum thickness of 0.25 inches, and any internal panes having a minimum thickness of 0.25 inches.

8. The glass door system of claim 6, further comprising a locking mechanism disposed within the first handle, the locking mechanism including an actuator having a locked and an unlocked position, the locked position including a locking pin axially extended from the first handle to be received by a locking pin aperture disposed within a header frame and the unlocked position including the locking pin axially retreated within the first handle such that the locking pin does not interfere with the opening and closing of the glass door leaf.

9. The glass door system of claim 6, further comprising the second handle secured to the first handle on an opposite the side of the glass door leaf, such that the first handle and second handle are aligned with a plane that is perpendicular to a plane in which the glass door leaf resides.

10. The glass door system of claim 6, further comprising a door frame configured to be secured within the door opening, the door frame including the header frame, the sill frame, and the first and second vertical door jambs, collectively forming a rectangular shape.

11. The glass door system of claim 10, further comprising the top rail adapted for pivotally mounting to the header and the bottom rail adapted for pivotally mounting to the sill.

12. A glass door system, comprising:

a door frame configured to be secured within a door opening, the door frame including a header, a sill, and two vertical door jambs, collectively forming a rectangular shape;

a first glass door leaf, the first glass door leaf including:

an interior pane having a minimum thickness of 0.25 inches, an exterior pane having a minimum thickness of 0.25 inches, and an internal pane having a minimum thickness of 0.25 inches, the interior, exterior, and internal panes of glass collectively defining a top edge, bottom edge, a first lateral edge, and a second lateral edge;

the first lateral edge being proximate to a first vertical door jamb, and there being no visible framing supports extending along the first and second lateral edges;

a top rail that engages the top edge and is adapted to enhance the structural integrity along a lateral extent of the first glass door leaf, and the top rail adapted for pivotally mounting to the header;

a bottom rail that engages the bottom edge and is adapted to enhance the structural integrity along the lateral extent of the first glass door leaf, and the bottom rail adapted for pivotally mounting to the sill;

a first handle on an interior surface of the first glass door leaf extending in a vertical direction and secured to the top and bottom rails proximate to the second lateral edge;

a second handle on an exterior surface of the first glass door leaf extending in a vertical direction and secured to the top and bottom rails proximate to the second lateral edge;

the first handle aligned and secured to the second handle along a plane perpendicular to a plane of the first glass door leaf;

at least one of the first and second handles further includes a locking mechanism disposed therein, the locking mechanism including an actuator having a locked and an unlocked position, the locked position including an upper locking pin axially extended into a header locking pin aperture disposed within the header and a lower locking pin axially extended into a sill locking pin aperture disposed within the sill;

a jamb pocket disposed on the inwardly facing surface of the first vertical door jamb, the jamb pocket including:

a first vertical support having a width extending from the first vertical door jamb towards the middle of the door frame and having a length extending vertically with the first vertical door jamb, the width establishing a planar contacting surface that is generally parallel to a plane in which the glass door leaf resides when in a closed orientation;

a second vertical support having a width extending from the first vertical door jamb towards the middle of the door frame and having a length extending vertically with the first vertical door jamb, the width establishing a planar contacting surface that is generally parallel to the plane in which the glass door leaf resides when in the closed orientation;

the first vertical support separated from the second vertical support in a direction perpendicular to the plane of the glass door leaf when the glass door leaf is in the closed orientation, the separation of the first and second vertical supports creating a receiving space for the first lateral edge of the glass door leaf;

whereby the combination of minimum thicknesses of each pane of glass, the planar contacting surfaces of the vertical supports, and the locked position of the locking mechanism in at least one of the first and second handles creates a glass door system that meets impact standards without vertical framing attached to the first and second lateral edges of the first glass leaf.

13. The glass door system of claim 12, further comprising:

a second glass door leaf, the second glass door leaf including:

an interior pane having a minimum thickness of 0.25 inches, an exterior pane having a minimum thickness of 0.25 inches, and an internal pane having a minimum thickness of 0.25 inches, the interior, exterior, and internal panes of glass collectively defining a top edge, bottom edge, a first lateral edge, and a second lateral edge;

the first lateral edge being proximate to a second vertical doorjamb, and there being no visible framing supports extending along the first and second lateral edges;

a top rail that engages the top edge and is adapted to enhance the structural integrity along a lateral extent of the second glass door leaf, and the top rail adapted for pivotally mounting to the header;

a bottom rail that engages the bottom edge and is adapted to enhance the structural integrity along the lateral extent of the second glass door leaf, and the bottom rail adapted for pivotally mounting to the sill;

a first handle on an interior surface of the second glass door leaf extending in a vertical direction and secured to the top and bottom rails proximate to the second lateral edge;

a second handle on an exterior surface of the second glass door leaf extending in a vertical direction and secured to the top and bottom rails proximate to the second lateral edge;

the first handle aligned and secured to the second handle along a plane perpendicular to a plane of the second glass door leaf;

at least one of the first and second handles further includes a locking mechanism disposed therein, the locking mechanism including an actuator having a locked and an unlocked position, the locked position including an upper locking pin axially extended into a header locking pin aperture disposed within the header and a lower locking pin axially extended into a sill locking pin aperture disposed within the sill;

a jamb pocket disposed on the inwardly facing surface of the second vertical door jamb, the jamb pocket including:

a first vertical support having a width extending from the second vertical door jamb towards the middle of the door frame and having a length extending vertically with the second vertical door jamb, the width establishing a planar contacting surface that is generally parallel to a plane in which the second glass door leaf resides when in a closed orientation;

a second vertical support having a width extending from the second vertical door jamb towards the middle of the door frame and having a length extending vertically with the second vertical door jamb, the width establishing a planar contacting surface that is generally parallel to the plane in which the second glass door leaf resides when in the closed orientation;

the first vertical support separated from the second vertical support in a direction perpendicular to the plane of the glass door leaf when the second glass door leaf is in the closed orientation, the separation of the first and second vertical supports creating a receiving space for the first lateral edge of the second glass door leaf;

whereby the combination of minimum thicknesses of each pane of glass, the planar contacting surfaces of the vertical supports, and the locked position of the locking mechanism in at least one of the first and second handles creates a glass door system that meets impact standards without vertical framing attached to the first and second lateral edges of the second glass leaf.

14. The glass door system of claim 13, further comprising a seal between the first vertical support in each jamb pocket and each respective glass door leaf, and a seal between the second vertical support in each jamb pocket and each respective glass door leaf.

15. The glass door system of claim 13, further comprising a seal between the first lateral edge of each door leaf and each respective door jamb.

* * * * *